US009285088B2

(12) United States Patent
Rolfes et al.

(10) Patent No.: US 9,285,088 B2
(45) Date of Patent: Mar. 15, 2016

(54) LINEAR LIGHT EMITTING DIODE INCLUSIVE FIXTURE

(75) Inventors: Tyler John Rolfes, Cleveland, OH (US); Jeffrey Nall, Brecksville, OH (US); Adrian Slattery, Rocky River, OH (US)

(73) Assignee: GE LIGHTING SOLUTIONS, LLC, Cleveland, OH (US)

( * ) Notice: Subject to any disclaimer, the term of this patent is extended or adjusted under 35 U.S.C. 154(b) by 16 days.

(21) Appl. No.: 12/971,928

(22) Filed: Dec. 17, 2010

(65) Prior Publication Data

US 2012/0153865 A1 Jun. 21, 2012

(51) Int. Cl.

| | |
|---|---|
| ***F21S 4/00*** | (2006.01) |
| ***F21K 99/00*** | (2010.01) |
| ***F21V 23/00*** | (2015.01) |
| ***F21V 29/507*** | (2015.01) |
| *F21Y 101/02* | (2006.01) |
| *F21Y 105/00* | (2006.01) |

(52) U.S. Cl.

CPC . *F21S 4/008* (2013.01); *F21K 9/17* (2013.01); *F21V 23/003* (2013.01); *F21V 29/507* (2015.01); *F21Y 2101/02* (2013.01); *F21Y 2105/001* (2013.01)

(58) Field of Classification Search

CPC ..... F21S 4/008; F21K 9/10; F21K 9/135; F21V 23/00; F21V 23/001; F21V 23/002; F21V 23/003; F21V 23/004; F21V 23/005; F21V 23/006; F21V 23/007; F21V 23/008; F21V 23/009; F21Y 2101/02

USPC ..... 362/249.02–249.04, 217.1–217.17, 362/225, 310, 217.01, 311.02

See application file for complete search history.

(56) References Cited

U.S. PATENT DOCUMENTS

| | | | | |
|---|---|---|---|---|
| 5,463,280 | A | 10/1995 | Johnson | |
| 6,860,628 | B2 | 3/2005 | Robertson et al. | |
| 6,936,968 | B2 | 8/2005 | Cross et al. | |
| 7,049,761 | B2 | 5/2006 | Timmermans et al. | |
| 7,053,557 | B2 | 5/2006 | Cross et al. | |
| 7,067,992 | B2 | 6/2006 | Leong et al. | |
| 7,114,830 | B2 | 10/2006 | Robertson et al. | |
| 7,307,391 | B2 | 12/2007 | Shan | |
| 7,507,001 | B2 | 3/2009 | Kit | |
| 7,736,020 | B2 * | 6/2010 | Baroky et al. | 362/249.02 |
| 7,887,226 | B2 * | 2/2011 | Huang et al. | 362/581 |
| 8,066,411 | B1 * | 11/2011 | Barton et al. | 362/310 |
| 8,220,956 | B2 * | 7/2012 | Lai et al. | 362/218 |
| 2005/0265019 | A1 * | 12/2005 | Sommers et al. | 362/217 |
| 2009/0073693 | A1 * | 3/2009 | Nall et al. | 362/249.02 |
| 2011/0019421 | A1 * | 1/2011 | Lai | F21K 9/17 362/249.06 |

FOREIGN PATENT DOCUMENTS

| | | | |
|---|---|---|---|
| CN | 201351882 | Y | 11/2009 |
| WO | 2009148237 | A2 | 12/2009 |

OTHER PUBLICATIONS

Unofficial English translation of Office Action issued in connection with corresponding CN Application No. 201110436085.4 on Dec. 18, 2014.

* cited by examiner

*Primary Examiner* — Robert May
(74) *Attorney, Agent, or Firm* — Fay Sharpe LLP

(57) ABSTRACT

A lighting assembly for an existing linear fluorescent fixture includes a support, at least two opposing light emitting diodes (LED) on respective sides of the support configured to direct light in opposite general directions, a housing configured to cover the support and the at least two opposing LEDs; and end caps including electrical connectors to connect to electrical connections of the existing linear fluorescent fixture.

16 Claims, 7 Drawing Sheets

LINEAR LIGHT EMITTING DIODE INCLUSIVE FIXTURE

BACKGROUND

The present exemplary embodiments relate to the illumination arts, lighting arts, and related arts. It finds particular application in conjunction with the replacement of fluorescent light systems with light emitting diode (LED) based light sources, and will be described with particular reference thereto. However, it is to be appreciated that the present exemplary embodiments are also amenable to other like applications.

Box signs generally use conventional fluorescent lights and high voltage fluorescent lighting fixtures as the lighting system. The conventional fluorescent lights illuminate both the front and rear panels of the box sign. As LEDs become more popular and prevalent, it has become desirable to replace the conventional fluorescent lights in box signs with LED lighting units.

There are several challenges to replacing fluorescent lights with LED lighting units. For example, typical replacement LED lighting units for conventional high voltage fluorescent lighting fixtures utilize a large number of light emitting diodes (LEDs) to produce the desired light. The LEDs are disposed in a single-sided translucent tube in a string like configuration which emits light in only one direction. For a replacement LED lighting unit to properly illuminate a box sign, multiple strings of LEDs facing in opposite directions would be required in order to illuminate both the front and rear panels resulting in a high cost for the LEDs. Additionally, replacing conventional fluorescent lights with replacement LED lighting units requires the existing ballasts and fixtures to be modified or replaced in order for the replacement LED lighting units to properly operate or removal of the ballast and running the replacement lamp on main voltage using an electronic driver built into the LED lamp thus further increasing the cost.

SUMMARY

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to one aspect of the present disclosure, a lighting assembly for an existing linear fluorescent fixture is provided. The lighting assembly includes a support, at least two opposing light emitting diodes (LED) on respective sides of the support configured to direct light in oppositely general directions, and a housing configured to cover the support and the at least two opposing LEDs. End caps including electrical connectors to connect to electrical connections of the existing linear fluorescent fixture are also provided.

According to another aspect of the present disclosure, a lighting assembly is provided. The lighting assembly includes a plurality of supports and at least one light emitting diode (LED) on an outward side of each of the plurality of supports. At least two of the LEDs emit light in opposite general directions. A housing is configured to cover the plurality of supports and the LEDs is also provided. End caps including electrical connectors to connect to electrical connections of the existing linear fluorescent fixture are also provided.

According to another aspect of the present disclosure, a lighting assembly for illuminating a sign is provided. The assembly includes a first support having at least one first LED for emitting light in a first general direction, a second support including at least one second LED for emitting light in a second general direction, which is substantially opposite the first general direction. A housing is configured to cover the first and second supports and the at least one first and second LEDs. A structural reinforcement is provided for facilitating proper orientation of the first and second support in relation to the housing. The structural reinforcement defines an opening between the first and second supports.

DETAILED DESCRIPTION

Figure 1:
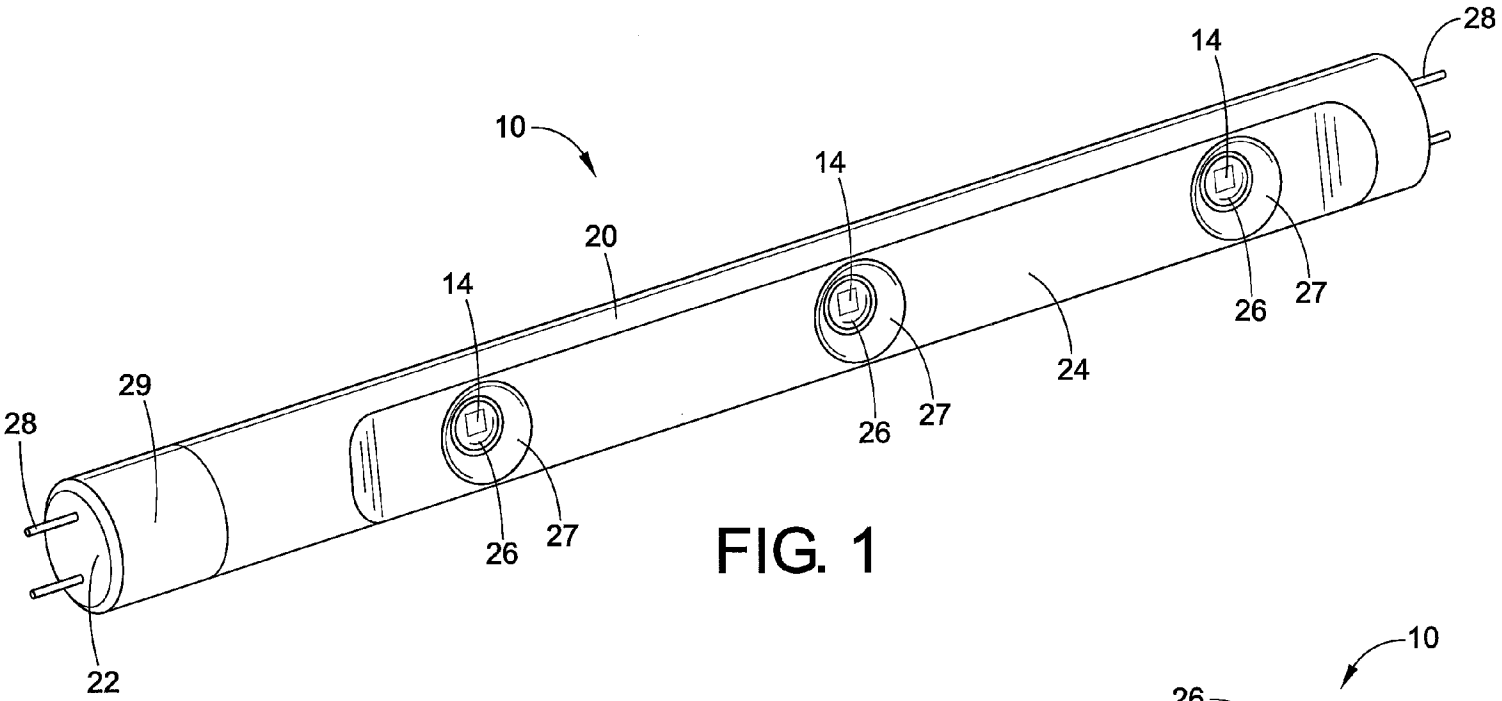
FIG. 1 is perspective view of a LED module in accordance with the present exemplary embodiment.

With reference to FIG. 1, a LED module 10 is shown that directly fits into existing linear fluorescent fixtures in applications such as office light fixtures, high bay lighting fixtures, signage fixtures, refrigeration fixtures, and the like. When fit in existing linear fluorescent fixtures, the LED module 10 illuminates opposing sides of the existing linear fluorescent fixtures. The LED module 10 also directly connects into the main power line or ballasts of the existing linear fluorescent fixtures through the bi-pin, recessed bi-pin, R17D sockets (recessed double bi-pin), or single pin connections of the existing linear fluorescent fixtures.

Figure 3:
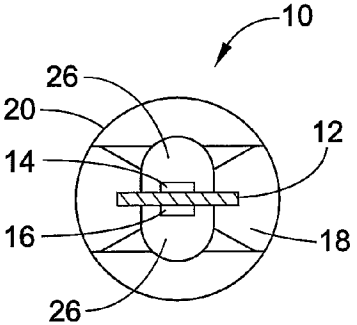
FIG. 3 is an end view of the LED module depicted in FIGS. 1 and 2.

The LED module 10 includes a support 12 (shown in FIG. 3), circuitry on the support, and at least two opposing LEDs 14 and 16 on respective sides of the support and electrically connected to the circuitry of the support 12 (shown in FIG. 3). The LED module 10 also includes structural reinforcement 18 which facilitates proper orientation the support 12 in relation to a housing 20. The housing 20 is configured over the support 12 for covering the LEDs 14 and 16 and the circuitry. End caps 22 are electrically connected with the support 12 at each end of the LED module 10 and are configured for connection with the housing 20. It is also contemplated that the end caps 22 electrically connect with the support 12 at just one end of the LED module 10.

With reference to FIG. 3, the support 12 is a double-sided printed circuit board (PCB). It is also contemplated that the support 12 is two single-sided PCBs back to back with each other. It is also contemplated that the support 12 is one single-side PCB. The depicted support 12 is a double-sided PCB having a first surface and second surface, which are parallel to each other. The PCBs can include electric (e.g. copper) traces formed on the first and second surfaces to act as a heat sink to dissipate the heat generated by the LEDs 14 and 16. The PCB can also be a metal core printed circuit board (MCPCB) to assist in dissipating heat generated by the LEDs 14 and 16. The structural reinforcement 18 can be a rigid foam matrix which also assists in the dissipation of heat generated from the support 12 and the LEDs 14 and 16. A suitable foam material would be polyurethane foam or the like. It is also contemplated that the structural reinforcement 18 may be an aluminum extrusion which also assists in the dissipation of heat generated from the support 12 and the LEDs 14 and 16.

Figure 2:
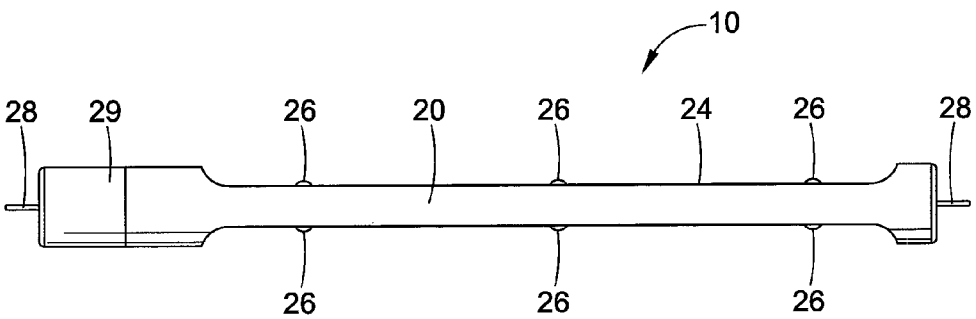
FIG. 2 is a side view of the LED module depicted in FIG. 1.

LEDs 14 mount on the first surface of the support 12 and emit light in a first general direction. LEDs 16 mount on the second surface of the support 12 and emit light in a second general direction, which is substantially opposite the first general direction. For example, when the LED module 10 is fit into an existing linear fluorescent fixture, LEDs 14 and 16 illuminate opposing sides of the linear fluorescent fixture. As illustrated in FIGS. 1 and 2, three LEDs are mounted on each of the first and second surfaces of the support 12. It is contemplated that the support 12 can include many small LEDs (e.g. 0.1 to 0.5 watt LEDs) or fewer larger LEDs (e.g. 1 watt LEDs). As shown in FIGS. 1 and 2, the distance between the LEDs 14 and 16 is uniform but it is contemplated that the distance between the LEDs 14 and 16 can also be non-uniform.

The housing 20 depicted in FIGS. 1-3 is an over-molded housing 20 that protects the circuitry and the LEDs 14 and 16 on the support 12. The over-molded housing 20 can be made from a thermally conductive plastic (such as a nylon, ABS plastic, polystyrene, or of any other suitable plastic), which aids in dissipating the heat generated by the LEDs 14 and 16. The over-molding housing 20 can also be a structural foam (such as polyurethane foam or the like) over-mold. Preferably, the housing material is non-transparent such that light emitted from the LEDs 14 and 16 cannot be seen through the housing body. The over-molded housing 20 is approximately 70% lighter than conventional injection molded resin.

The housing 20 is shown as generally tubular in cross section, but the housing can take additional configurations including square, rectangular, irregularly shaped, and the like. The housing 18 further includes a plurality of lenses 26. Each lens 26 is aligned to a corresponding LED such that light from each of the LEDs 14 and 16 is emitted from the housing 18. To promote the escape of light from the housing 18, the housing 18 includes a flat indentation or recess 24 formed along the length of the housing 18. To further encourage light to escape from the housing 18, the indentation or recess 24 includes conical chamfers 27, shown in FIG. 3, formed near each of the lenses to further increase the light path from the LEDs 14 and 16. The lenses 26 include a transparent section which allows direct light from the LEDs 14 and 16 to be emitted from the housing. Further, the transparent section of the lenses 26 can disperse the light emitted from the respective LEDs 14 and 16. It is also contemplated the lenses 26 are made from a material that allows heat generated from the support 12 and LEDs 14 and 16 to escape through the lens.

The end caps 22 include electrical connectors 28 that electrically connect the support 12 of the LED module 10 to the electrical connections of existing linear fluorescent fixtures. As shown in FIG. 1, the electrical connectors 28 are bi-pin connectors but it is contemplated that the electrical connectors 28 could be bi-pin connectors, recessed bi-pin connectors, R17D connectors (recessed double bi-pins connectors), single pin connectors, a section of plain electrical wire exiting from the lamp and only using the base for a support structure, and the like. It is also contemplated that the electric connectors directly connect to the main power line from the existing linear fluorescent fixture. The electric connectors 28 attach to the housing and electrically connect to the LEDs 14 and 16. In order for the LED module 10 to operate through the connection of the existing linear fluorescent fixtures, the LED module 10 includes electric power conditioning and regulating electronics and circuits, transformers, power supplies, and the like to convert the standard voltages used in fluorescent linear fixtures and main power lines to the appropriate LED voltage to power LEDs 14 and 16. For example, a power regulating circuit can regulate the flow of current to allow the LED module 10 to dynamically adapt to an increased load such as an additional LED. A power conditioning circuit may convert alternating current voltage to a direct current voltage. For example, the power conditioning circuit may convert 120 or 240 volt alternating current voltage to a direct current voltage. The power conditioning circuit may additionally, or alternatively, correct for polarity of the incoming power so that the power supply wires that connect to the LED module 10 can be connected without having to worry about which wire connects to which element of the power conditioning circuit. As shown in FIG. 2, the housing 20 further includes an electronics pack or opening 29 in the housing for locating or storing the various electronics and circuits needed to operate the LED module 10 in existing linear fluorescent fixtures.

Figure 4:
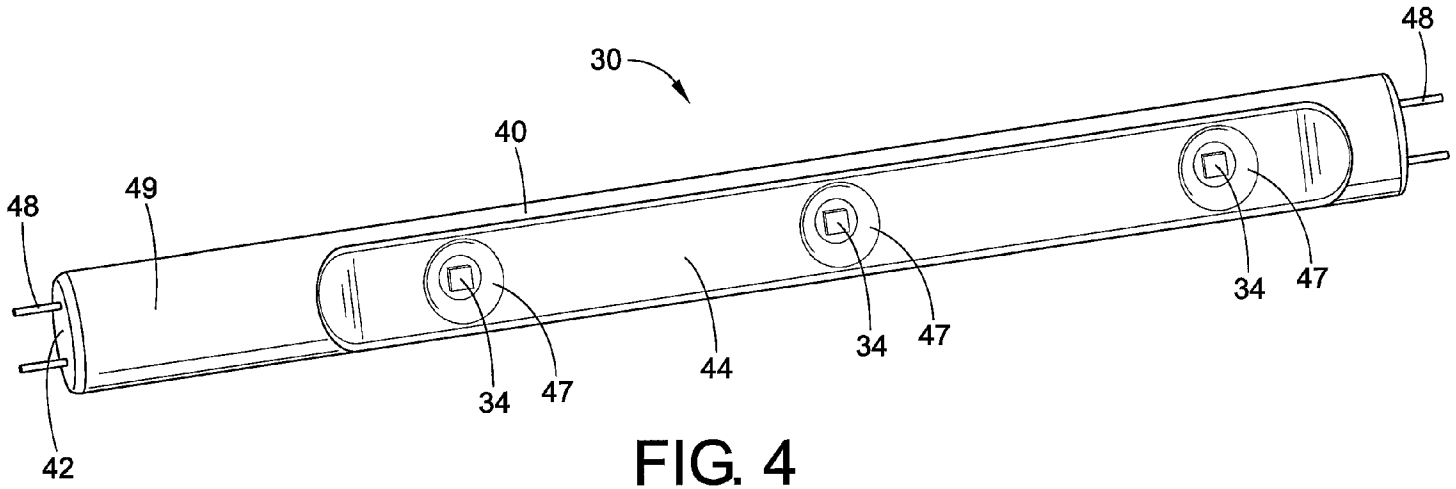
FIG. 4 is a perspective view of an alternative embodiment of a LED module in accordance with the present exemplary embodiment.
Figure 6:
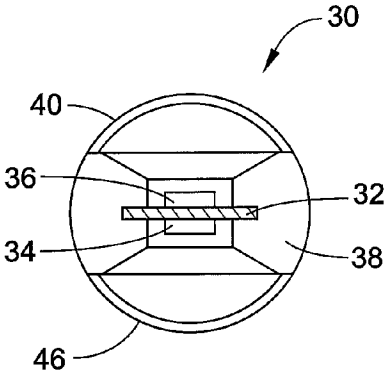
FIG. 6 is an end view of the LED module depicted in FIGS. 4 and 5.
Figure 5:
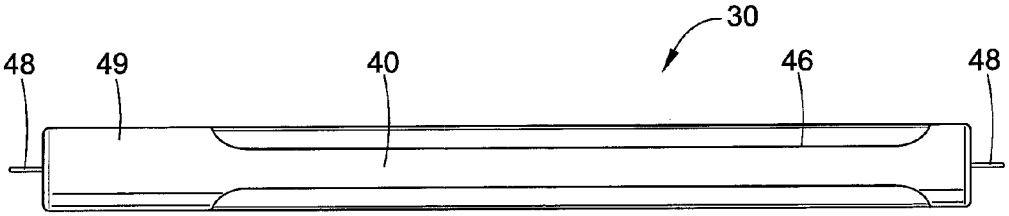
FIG. 5 is a side view of the LED module depicted in FIG. 4.

FIGS. 4-6 depicts an alternative embodiment of the LED module 30. The components that are shown in FIGS. 4-6 are similar to the components that are shown in FIG. 1-3 in that the LED module 30 includes a support 32, circuitry on the support 32, at least two opposing LEDs 34 and 36 on respective sides of the support and electrically connected to the circuitry of the support 32, and a housing 40 over the support for covering the LEDs 34 and 36 and the circuitry. The LED module 30 also includes a structural reinforcement 38 which facilitates proper orientation of the support 32 in relation to the housing 40. The housing 40 includes conical chamfers 47 aligned near corresponding LEDs to promote the escape of light from each of the LEDs 34 and 36 from the housing 40. The conical chamfers 47 are formed in a flat indentation or recess 44 formed along the length of the housing 18. The housing 40 also includes a lens 46 aligned along the indentation or recess 44 that enable the light from the LEDs 34 and 36 to be emitted from the housing 40. The lens 46 keeps the cylindrical form of the housing but it is also contemplated that the lens can help keep additional housing configurations. The lens 46 includes a transparent section which allows direct light from the LEDs 34 and 36 to be emitted from the housing.

The LED module 10 also includes end caps 42 that are electrically connected with the support 32 at each end of the LED module 10 and are configured for connection with the housing 40. The end caps 42 include electrical connectors 48 that electrically connect the support 32 of the LED module 10 to the electrical connections of existing linear fluorescent fixtures. The housing 40 further includes an electronics pack or opening 49 in the housing for locating or storing the various electronics needed to operate the LED module 10 in existing linear fluorescent fixtures.

Figure 7:
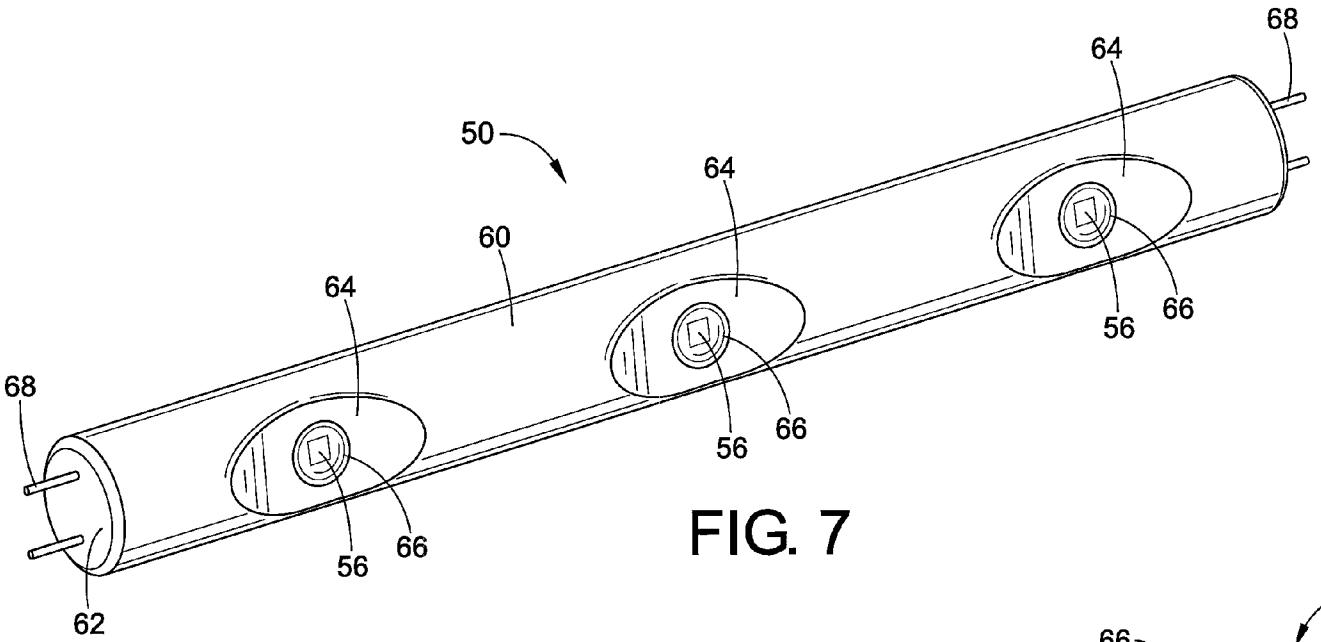
FIG. 7 is a perspective view of another alternative embodiment of a LED module in accordance with the present exemplary embodiment.
Figure 9:
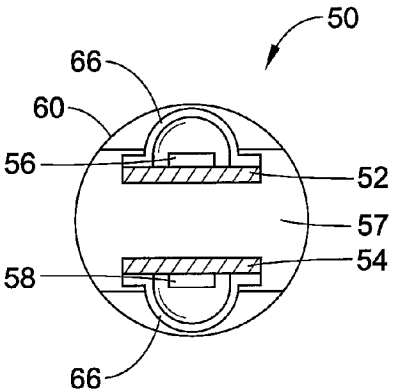
FIG. 9 is an end view of the LED module depicted in FIGS. 7 and 8.
Figure 8:
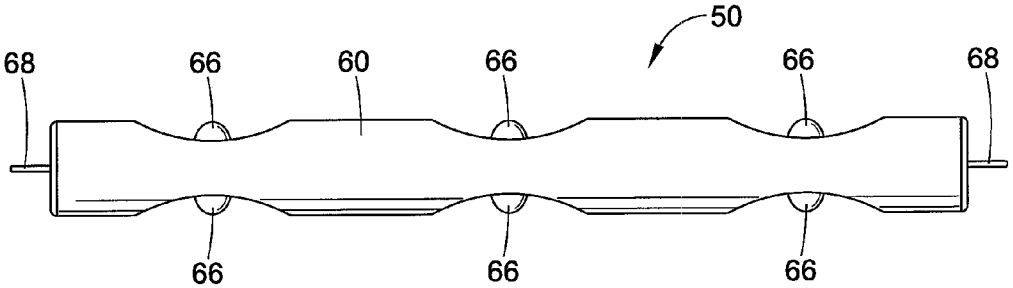
FIG. 8 is a side view of the LED module depicted in FIG. 7.

With reference to FIGS. 7-9, another alternative embodiment of the LED module 50 is illustrated. The components that are shown in FIGS. 7-9 are similar to the components that are shown in FIG. 1-3. The LED module 50 includes two supports 52 and 54, circuitry on the supports 52 and 54, at least one LED 56 and 58 on the outward sides of the supports 52 and 54 and electrically connected to the circuitry of the supports 52 and 54, and a housing 60 over the support for covering the LEDs 56 and 58 and the circuitry. The supports 52 and 54 are positioned on respective sides of the housing such that an opening 57 is formed in the housing. The opening 57 in the housing can store the various electronics needed to operate the LED module 50 in existing linear fluorescent fixtures. For example, the opening 57 stores the electric power conditioning and regulating electronics and circuits, transformers, power supplies, and the like to convert the standard voltages used in fluorescent linear fixtures and main power lines to the appropriate LED voltage to power LEDs 56 and 58. The LED module 50 also includes structural reinforcement (not shown) which facilitates proper orientation of the supports 52 and 54 in relation to the housing 60.

LED 56 mount on the outward surface of support 52 and emit light in a first general direction. LED 58 mount on the outward surface of the support 54 and emit light in a second general direction, which is opposite the first general direction. The housing 60 further includes a plurality of lenses 66. Each lens 66 is aligned to a corresponding LED such that light from each of the LEDs 56 and 58 is emitted from the housing 60. To promote the escape of light from the housing 18, the housing 18 includes a chamfer or recess 64 formed near each of the LEDs 56 and 58. The lens 66 includes a transparent section which allows direct light from the LEDs 56 and 58 to be emitted from the housing.

The LED module 50 also includes end caps 62 that are electrically connected with the supports 52 and 54 at each end of the LED module 50 and are configured for connection with the housing 60. The end caps 62 include electrical connectors 68 that electrically connect the supports 52 and 54 of the LED module 50 to the electrical connections of existing linear fluorescent fixtures. The electrical connectors 58 include bi-pin connectors, recessed bi-pin connectors, R17D connectors (recessed double bi-pins connectors), single pin connectors, and the like. It is also contemplated that the electric connectors directly connect to the main power line from the existing linear fluorescent fixture.

Figure 10:
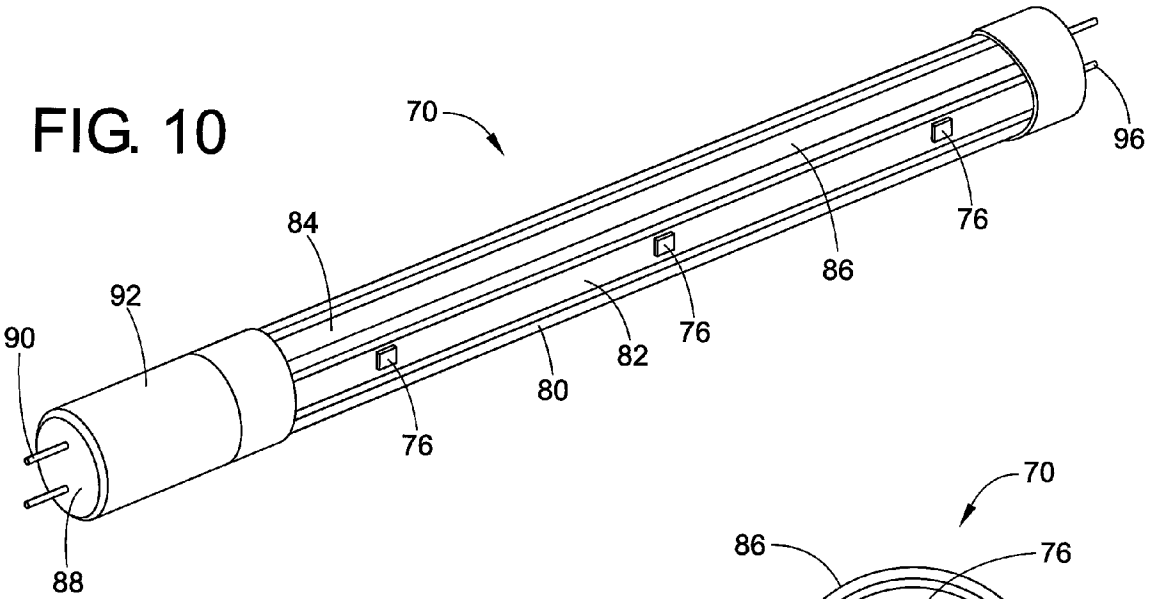
FIG. 10 is a perspective view of another alternative embodiment of a LED module in accordance with the present exemplary embodiment.
Figure 12:
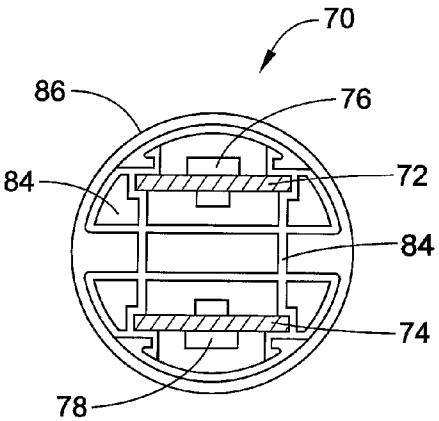
FIG. 12 is an end view of the LED module depicted in FIGS. 10 and 11.
Figure 11:
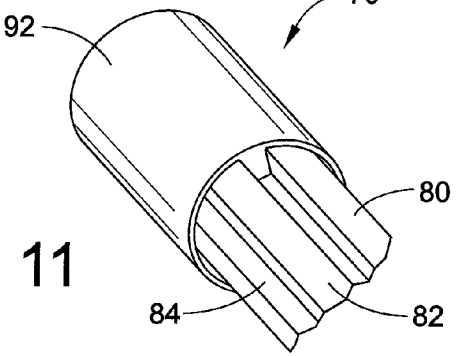
FIG. 11 is a side view of the LED module depicted in FIG. 10.

FIGS. 10-12 depicts an alternative embodiment of the LED module 10. The components that are shown in FIGS. 4-6 are similar to the components that are shown in FIG. 1-3 in that the LED module 70 includes two supports 72 and 74, circuitry on the supports 72 and 74, at least one LED 76 and 78 on the outward sides of the supports and electrically connected to the circuitry of the supports 72 and 74, and a housing 80 over the support for covering the LEDs 76 and 78 and the circuitry. The supports 72 and 74 are positioned on respective sides of the housing 80. The LED module 70 also includes structural reinforcement 82 which facilitates proper orientation of the supports 72 and 74 in relation to the housing 80. The structural reinforcement 82 is an aluminum extrusion. The structural reinforcement 82 includes a heat transfer channel 84 that runs along the length of the LED module 70 to dissipate the heat generated from the support and the LEDs 76 and 78. The structural reinforcement includes cooling ribs in the extrusion to define the heat transfer channel 84.

LEDs 76 mount on the outward surface of the support 72 and emit light in a first general direction. LEDs 78 mount on the outward surface of the support 74 and emit light in a second general direction, which is opposite the first general direction. The housing 80 is a transparent over molded housing or lens 86 that protects the circuitry and the LEDs 76 and 78 on the supports 72 and 74. The lens 86 is aligned along the length of the housing and enables the light from the LEDs 72 and 74 to be emitted from the housing 80. The lens 86 keeps the cylindrical form of the housing but it is also contemplated that the lens can help keep additional housing configurations.

The LED module 70 also includes end caps 88 that are electrically connected with the supports 72 and 74 at each end of the LED module 70 and are configured for connection with the housing 80. The end caps 88 include electrical connectors 90 that electrically connect the supports 72 and 74 of the LED module 70 to the electrical connections of existing linear fluorescent fixtures. The housing 80 further includes an electronics pack or opening 92 in the housing for locating or storing the various electronics needed to operate the LED module 70 in existing linear fluorescent fixtures. The end caps 88 include mating bosses such that the LED module 70 is sealed with the ribs of the structural reinforcement 82.

Figure 13:
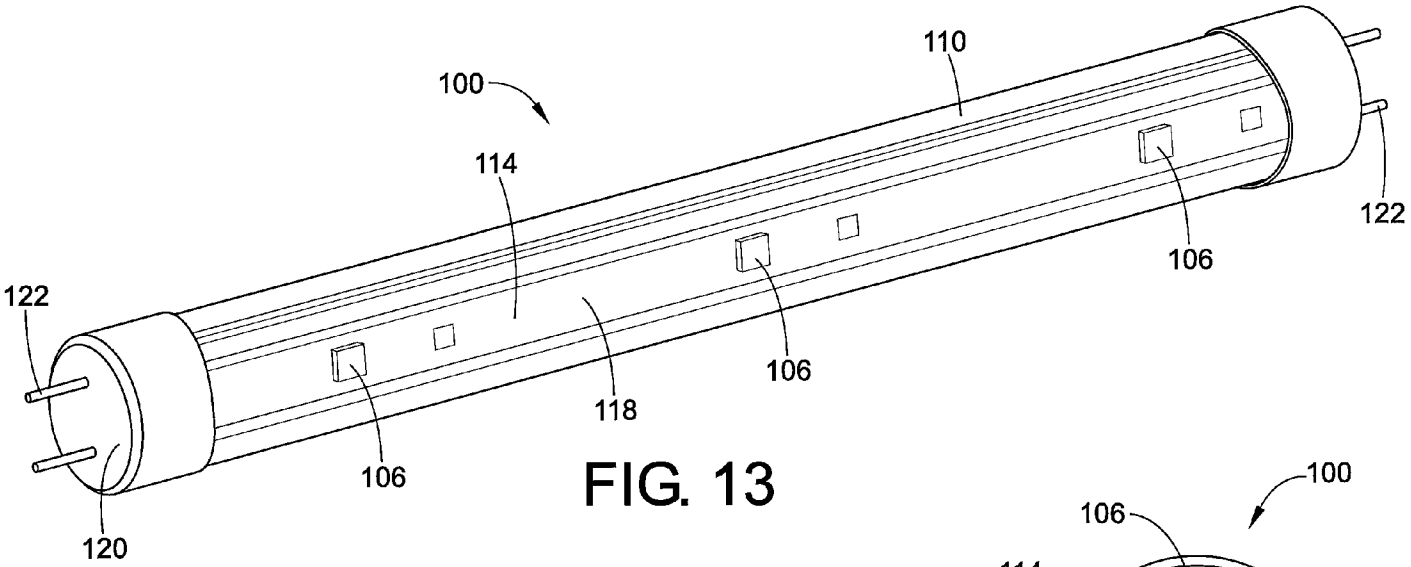
FIG. 13 is a perspective view of another alternative embodiment of a LED module in accordance with the present exemplary embodiment.
Figure 15:
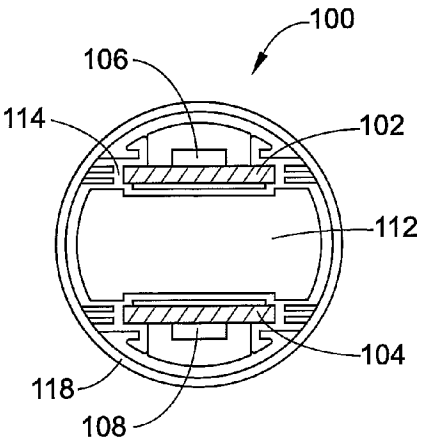
FIG. 15 is an end view of the LED module depicted in FIGS. 13 and 14.
Figure 14:
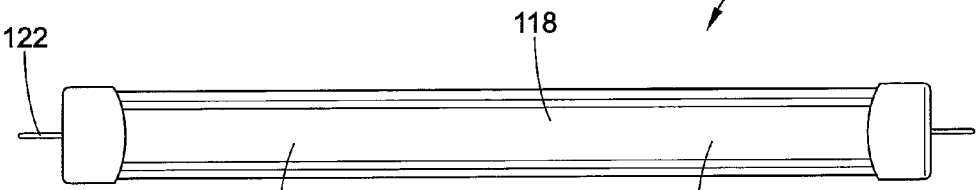
FIG. 14 is a side view of the LED module depicted in FIG. 13.

FIGS. 13-15 depicts an alternative embodiment of the LED module 100. The components that are shown in FIGS. 4-6 are similar to the components that are shown in FIG. 1-3 in that the LED module 100 includes two supports 102 and 104, circuitry on the supports 102 and 104, at least one LED 106 and 108 on the outward sides of the supports 102 and 104 and electrically connected to the circuitry of the supports 102 and 104, and a housing 110 over the support for covering the LEDs 106 and 108 and the circuitry. The supports 102 and 104 are positioned on respective sides of the housing such that an opening 112 is formed in the housing. The opening 112 in the housing can store the various electronics needed to operate the LED module 100 in existing linear fluorescent fixtures. For example, the opening stores the electric power conditioning and regulating electronics and circuits, transformers, power supplies, and the like to convert the standard voltages used in fluorescent linear fixtures and main power lines to the appropriate LED voltage to power LEDs 106 and 108. The LED module 100 also includes structural reinforcement 114 which facilitates proper orientation of the supports 102 and 104 in relation to a housing 110. The structural reinforcement 114 is an aluminum extrusion. The aluminum extrusion includes cooling ribs and a heat transfer channel 116 to dissipate the heat generated from the supports 102 and 104 and the LEDs 106 and 108.

LED 106 mount on the outward surface of the support 102 and emit light in a first general direction. LEDs 108 mount on the outward surface of the support 104 and emit light in a second general direction, which is opposite the first general direction. The housing 110 is a transparent over molded housing or lens 118 that protects the circuitry and the LEDs 106 and 108 on the supports 102 and 104. The lens 118 is aligned along the length of the housing and enables the light from the LEDs 106 and 108 to be emitted from the housing 110. The lens 118 keeps the cylindrical form of the housing but it is also contemplated that the lens can help keep additional housing configurations.

The LED module 100 also includes end caps 120 that are electrically connected with the supports 102 and 104 at each end of the LED module 100 and are configured for connection with the housing 110. The end caps 120 include electrical connectors 122 that electrically connect the supports 102 and 104 of the LED module 100 to the electrical connections of existing linear fluorescent fixtures.

Figure 16C:
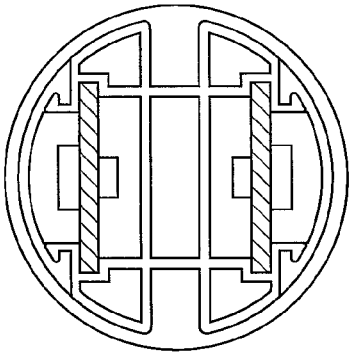
FIGS. 16A-16E are end views of a LED module in accordance with the present exemplary embodiment.
Figure 16B:
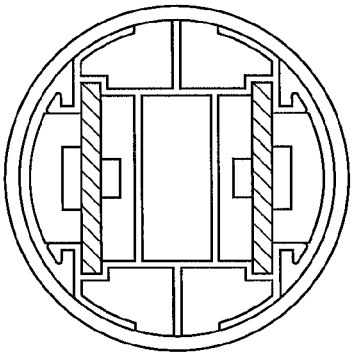
Figure 16A:
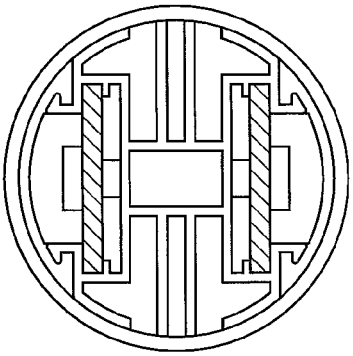
Figure 16E:
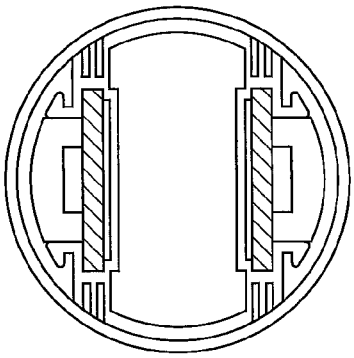
Figure 16D:
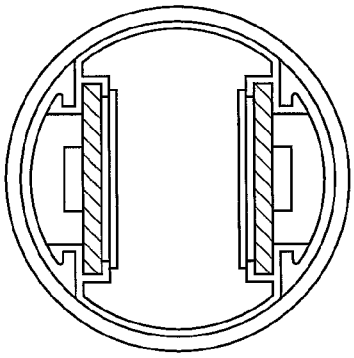

FIGS. 16*a*-16*e* depict the various configurations of the structural reinforcements of the LED module. FIG. 16*a* illustrates a structural reinforcement configuration for a two support LED module. The configuration includes cooling ribs in the center of the housing. The electronics components of the LED module are stored in an over molded electronic pack. FIG. 16*b* depicts a structural reinforcement configuration for a two support LED module including cooling ribs around the center of the housing. The electronics components of the LED module are stored in an over molded electronic pack. FIG. 16*c* includes a structural reinforcement configuration including two central cooling channels in a two support LED module. An electric pack stores the electronics components of the LED module. FIG. 16*d* depicts a structural reinforcement configuration that includes no cooling ribs which enables the electronic components to be stored in the housing of the LED module. FIG. 16*e* depicts a structural reinforcement configuration that includes tightly compacts cooling ribs directly at the supports which enables the electronic components to be stored in the housing of the LED module.

Figure 17:
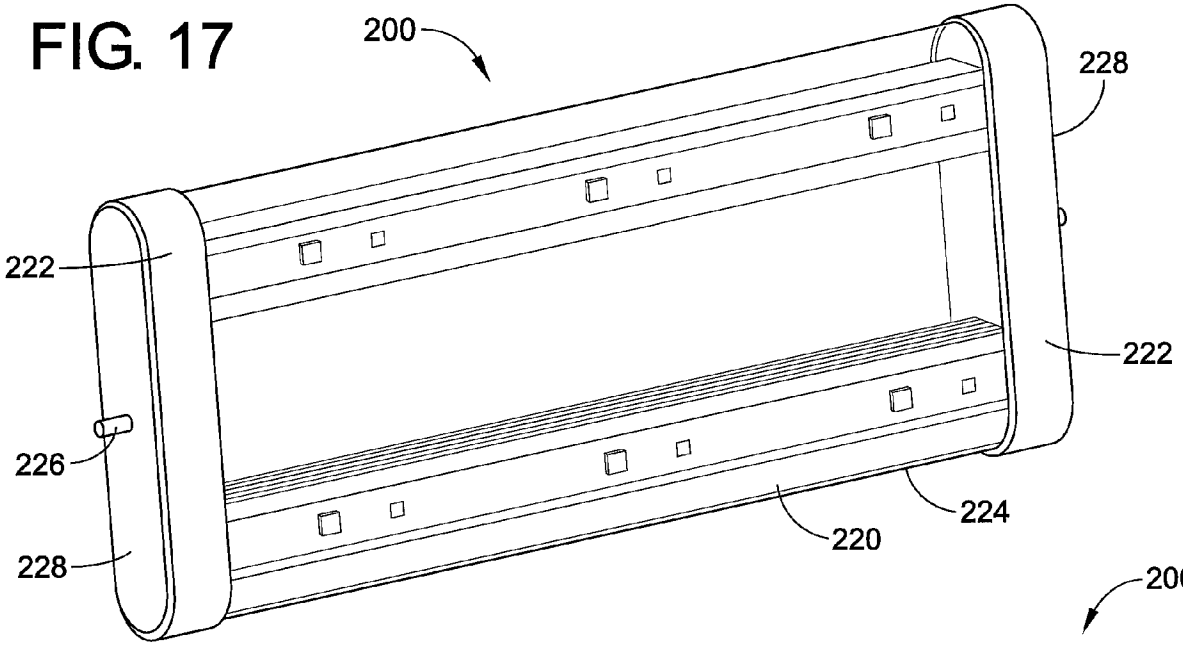
FIG. 17 is a perspective view of another alternative embodiment of a LED module in accordance with the present exemplary embodiment.
Figure 18:
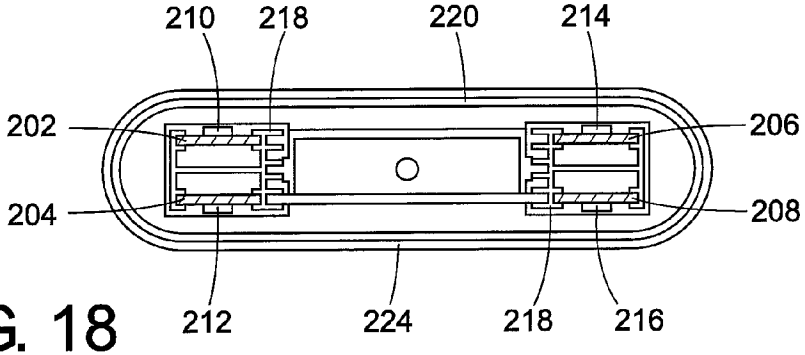
FIG. 18 is an end view of the LED module depicted in FIG. 17.

FIGS. 17 and 18 depict an alternative embodiment of the LED module 200. The components that are shown in FIGS. 17 and 18 are similar to the components that are shown in FIG. 1-3. A LED module 200 is shown that replaces two conventional fluorescent lights in an existing linear fluorescent fixture. The LED module 200 includes four supports 202, 204, 206, 208, circuitry on the supports, and at least one LED 210, 212, 214, 216 on respective sides of the supports and electrically connected to the circuitry of the supports 202, 204, 206, 208. The LED module 200 also includes structural reinforcement 218 which facilitates proper orientation of the supports 202, 204, 206, 208 in relation to a housing 220. The housing 220 is configured over the supports 202, 204, 206, 208 for covering the LEDs 210, 212, 214, 216 and the circuitry. The structural reinforcement 218 is an aluminum extrusion that includes cooling ribs to dissipate the heat generated from the support and the LEDs 210, 212, 214, 216. It is also contemplated the structural reinforcement 218 defines a heat transfer channel.

LEDs 210 and 214 mount on the outward surface of the respective supports 202 and 206 and emit light in a first general direction. LEDs 212 and 216 mount on the outward surface of the respective support 204 and 208 and emit light in a second general direction, which is opposite the first general direction. The housing 220 is a transparent over molded housing or lens 224 that protects the circuitry and the LEDs 210, 212, 214, 216 on the supports 202, 204, 206, 208. The lens 224 is aligned along the length of the housing and enables the light from the LEDs 210, 212, 214, 216 to be emitted from the housing 220. The lens 224 keeps the tubular form of the housing but it is also contemplated that the lens can help keep additional housing configurations.

The LED module 200 also includes end caps 222 that are electrically connected with the supports 202, 204, 206, 208 at each end of the LED module 200 and are configured for connection with the housing 220. The end caps 222 include electrical connectors 226 that electrically connect the supports 202, 204, 206, 208 of the LED module 200 to the electrical connections of existing linear fluorescent fixtures. The housing 200 further includes an electronics pack or opening 228 in the housing for locating or storing the various electronics needed to operate the LED module 200 in existing linear fluorescent fixtures.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A lighting assembly for a linear fixture comprising:

a structural reinforcement configure to receive at least two printed circuit boards;

said two printed circuit boards oriented at least substantially parallel to each other and retained by said structural reinforcement;

at least two light emitting diodes (LED) on opposing sides of the two printed circuit boards and configured to direct light in oppositely general directions;

a housing comprised of an overmolded material selected from plastic, foam and mixtures thereof, and configured to cover the structural reinforcement and said printed circuit boards, said housing forming an outermost surface of said fixture, said housing including at least two chamfer and lens arrangements, each arrangement aligned with a corresponding LED; and electrical connectors to connect to electrical connections of the linear fixture.

2. The assembly according to claim 1, wherein the housing is non-transparent.

3. The assembly according to claim 1, wherein the housing includes a recess formed along a length of the housing, said chamfer and lens arrangements disposed within said recess.

4. The lighting assembly of claim 3 wherein said recess defines a planar surface.

5. The assembly according to claim 1, wherein the structural reinforcement includes at least one of a plurality of cooling ribs and a heat transfer channel.

6. The assembly according to claim 1, wherein the fixture includes electronics configured to convert AC current into DC current.

7. The lighting assembly of claim 1, wherein said housing includes at least one cylindrical portion.

8. The lighting assembly of claim 7, wherein said housing includes a cylindrical portion disposed at each end.

9. A lighting assembly comprising:

a structural reinforcement configured to facilitate proper orientation of a plurality of supports in relation to a housing, the structural reinforcement defining an opening between the at least two supports facing in opposite general directions;

at least one light emitting diode (LED) on a outward side of each of the plurality of supports, at least two of the LEDs emitting light in opposite general directions;

a housing forming an outermost surface of said assembly and comprised of an overmolded material selected from plastic, foam and mixtures thereof, and configured to have at least end regions circular in cross-section, said housing further configured to cover the plurality of supports and the LEDs, and wherein the housing is non-transparent and includes a plurality of lens and chamfer arrangements, each lens and chamfer arrangement being aligned with a corresponding LED; and electrical connectors to connect to an electrical fixture.

10. The assembly of claim 9, wherein the structural reinforcement defines at least one of a plurality of cooling ribs and a heat transfer channel.

11. The assembly according to claim 9, wherein the electrical connectors include at least one of bi-pin connectors, recessed bi-pin connectors and R17D connectors.

12. The assembly of claim 9, wherein said material is selected from nylon, ABS plastic, polystyrene, and polyurethane foam.

13. The lighting assembly of claim 9, wherein said first supports comprise a first side of a PCB and an opposed second side of said PCB.

14. The lighting assembly of claim 1, wherein the electrical connectors include at least one of bi-pin connectors, recessed bi-pin connectors, and R17D connectors.

15. The lighting assembly of claim 9, wherein said housing includes at least one cylindrical portion.

16. The lighting apparatus of claim 15, wherein said housing includes a cylindrical portion disposed at each end.

* * * * *